US010112805B1

(12) United States Patent
Joralmon

(10) Patent No.: US 10,112,805 B1
(45) Date of Patent: Oct. 30, 2018

(54) PALLET-PULLING DEVICE

(71) Applicant: Keith Joralmon, Peoria, AZ (US)

(72) Inventor: Keith Joralmon, Peoria, AZ (US)

( * ) Notice: Subject to any disclaimer, the term of this patent is extended or adjusted under 35 U.S.C. 154(b) by 0 days.

(21) Appl. No.: 15/846,427

(22) Filed: Dec. 19, 2017

(51) Int. Cl.

| | |
|---|---|
| ***B66C 1/34*** | (2006.01) |
| ***B66C 1/66*** | (2006.01) |
| ***B66F 9/19*** | (2006.01) |
| ***B65D 19/38*** | (2006.01) |

(52) U.S. Cl.
CPC ..... *B66C 1/66* (2013.01); *B65D 19/38* (2013.01); *B66F 9/19* (2013.01); *B65D 2519/00781* (2013.01)

(58) Field of Classification Search
CPC ..... B66C 1/66; F16B 45/025
USPC ..... 294/82.1, 82.11, 82.13, 82.14, 82.17, 294/82.23
See application file for complete search history.

(56) References Cited

U.S. PATENT DOCUMENTS

| | | | | |
|---|---|---|---|---|
| 2,913,131 | A * | 11/1959 | Holmes | B60P 3/125 280/493 |
| 3,073,613 | A | 1/1963 | Bergstrom | |
| 3,727,966 | A | 4/1973 | Stockwell | |
| 4,094,544 | A | 6/1978 | Spaine | |
| 4,114,941 | A * | 9/1978 | Heaton | B66F 9/19 280/24 |
| 4,171,842 | A * | 10/1979 | Tolle | B66C 1/34 294/82.1 |
| 4,421,353 | A | 12/1983 | Smith, Jr. | |
| 4,629,238 | A | 12/1986 | Woodruff | |
| D315,239 | S | 3/1991 | Krause | |
| D416,120 | S * | 11/1999 | Campolito | D34/28 |
| 6,367,779 | B1 * | 4/2002 | Martin | B25B 27/02 254/243 |
| D570,574 | S * | 6/2008 | Liebenstein | D34/28 |
| 7,562,921 | B2 * | 7/2009 | Fitzgerald | B66C 1/62 294/82.1 |
| D642,354 | S * | 7/2011 | Diegel | D34/38 |

FOREIGN PATENT DOCUMENTS

WO 1999067167 A 12/1999

* cited by examiner

*Primary Examiner* — Paul T Chin
(74) *Attorney, Agent, or Firm* — Kyle A. Fletcher, Esq.

(57) ABSTRACT

The pallet-pulling device is used to pull a cargo pallet from a location inside of a semi-trailer or other elevated shipping container to a location near the door of the container so that a forklift can access the pallet. The pallet-pulling device comprises a skid puller, a bridle chain, and a clevis hook. The skid puller comprises a plurality of vertical ribs coupled to a backing plate and a pull plate. The skid puller is placed in a pallet where a leading edge of the pull plate hooks onto a plank of the pallet. The skid puller rests on the backing plate, against the floor of the shipping container. The bridle chain couples the skid puller to a clevis hook. A chain coupled to a forklift is coupled to the clevis hook to allow the forklift to pull the pallet out of the container.

19 Claims, 4 Drawing Sheets

PALLET-PULLING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of cargo handling equipment, more specifically, a pallet-pulling device.

SUMMARY OF INVENTION

The pallet-pulling device is used to pull a cargo pallet from a location inside of a semi-trailer or other elevated shipping container to a location near the door of the container so that a forklift can access the pallet. The pallet-pulling device comprises a skid puller, a bridle chain, and a clevis hook. The skid puller comprises a plurality of vertical ribs coupled to a backing plate and a pull plate. The skid puller is placed in a pallet where a leading edge of the pull plate hooks onto a plank of the pallet. The skid puller rests on the backing plate, against the floor of the shipping container. The bridle chain couples the skid puller to a clevis hook. A chain coupled to a forklift is coupled to the clevis hook to allow the forklift to pull the pallet out of the container.

An object of the invention is to provide a skid puller that couples to a cargo pallet.

Another object of the invention is to allow the skid puller to be pulled by a forklift.

A further object of the invention is to provide a bridle chain that directs the motion of the pallet towards the forklift that is pulling.

Yet another object of the invention is to provide a pallet-pulling device that is easy to attached to and detach from a pallet.

These together with additional objects, features and advantages of the pallet-pulling device will be readily apparent to those of ordinary skill in the art upon reading the following detailed description of the presently preferred, but nonetheless illustrative, embodiments when taken in conjunction with the accompanying drawings.

In this respect, before explaining the current embodiments of the pallet-pulling device in detail, it is to be understood that the pallet-pulling device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pallet-pulling device.

It is therefore important that the claims be regarded as including such equivalent construction insofar as they do not depart from the spirit and scope of the pallet-pulling device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
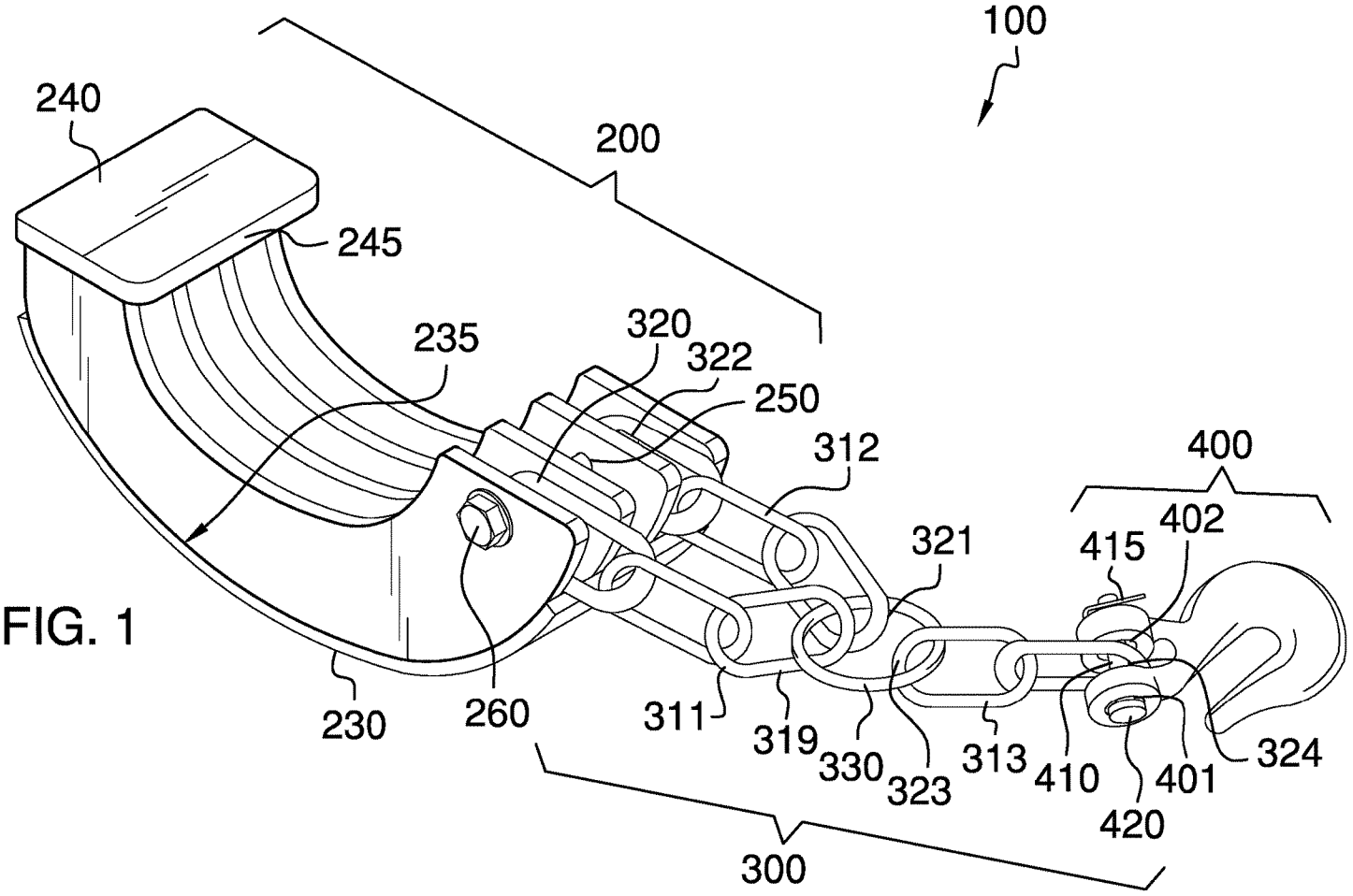
FIG. 1 is a perspective view of an embodiment of the disclosure.
Figure 2:
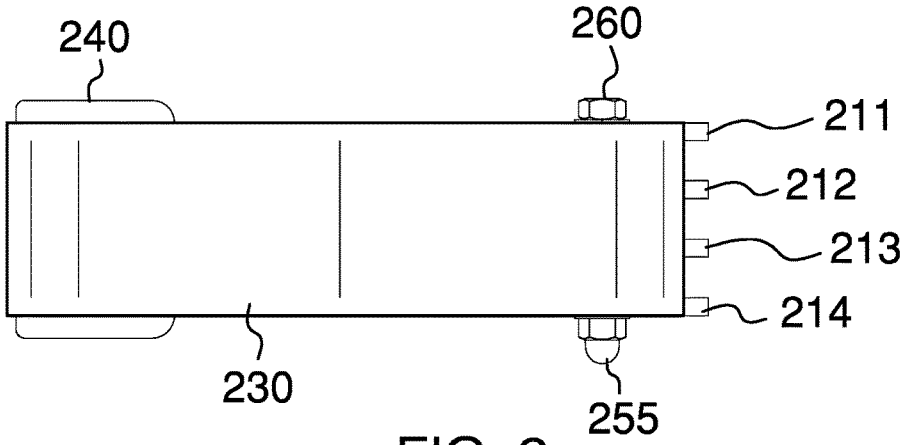
FIG. 2 is a bottom view of an embodiment of the disclosure, shown without the bridle chain and clevis grab hook for clarity.
Figure 3:
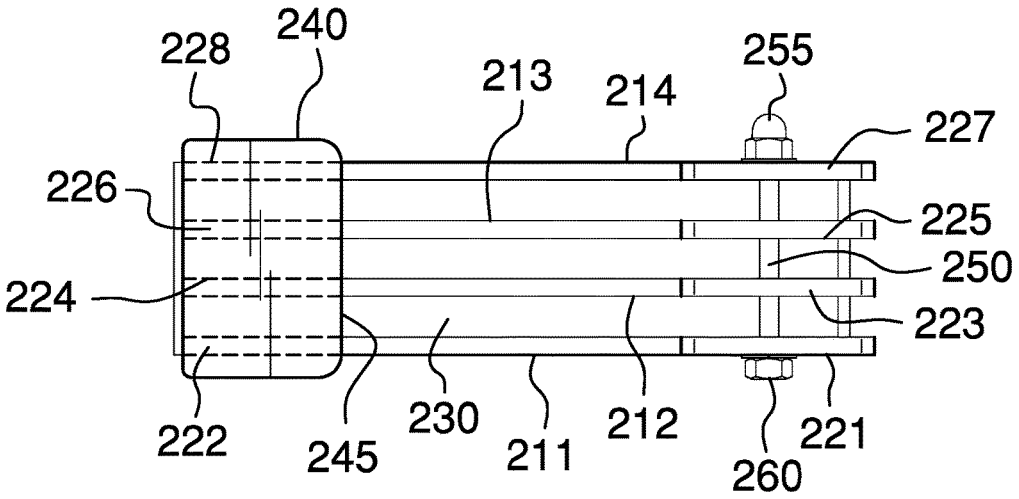
FIG. 3 is a top view of an embodiment of the disclosure, shown without the bridle chain and clevis grab hook for clarity.
Figure 4:
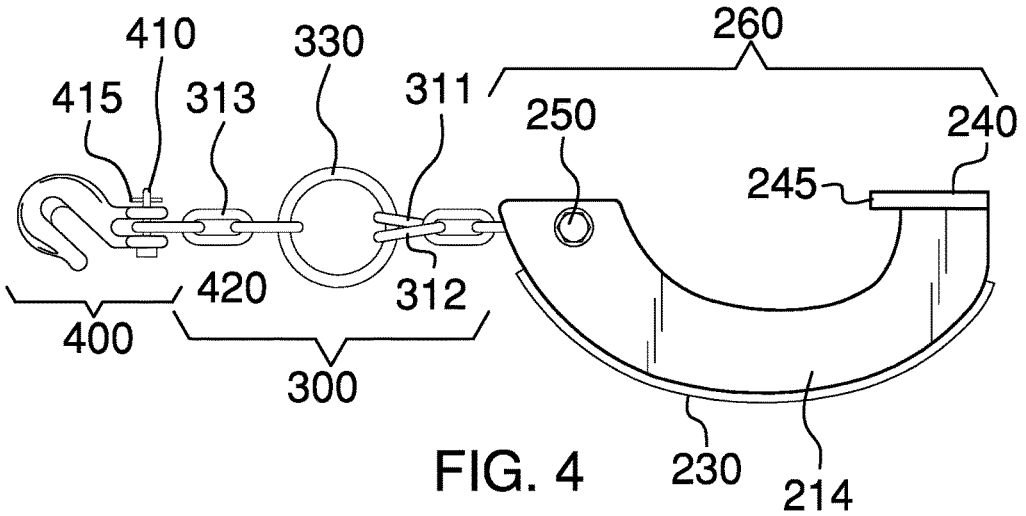
FIG. 4 is a side view of an embodiment of the disclosure.
Figure 5:
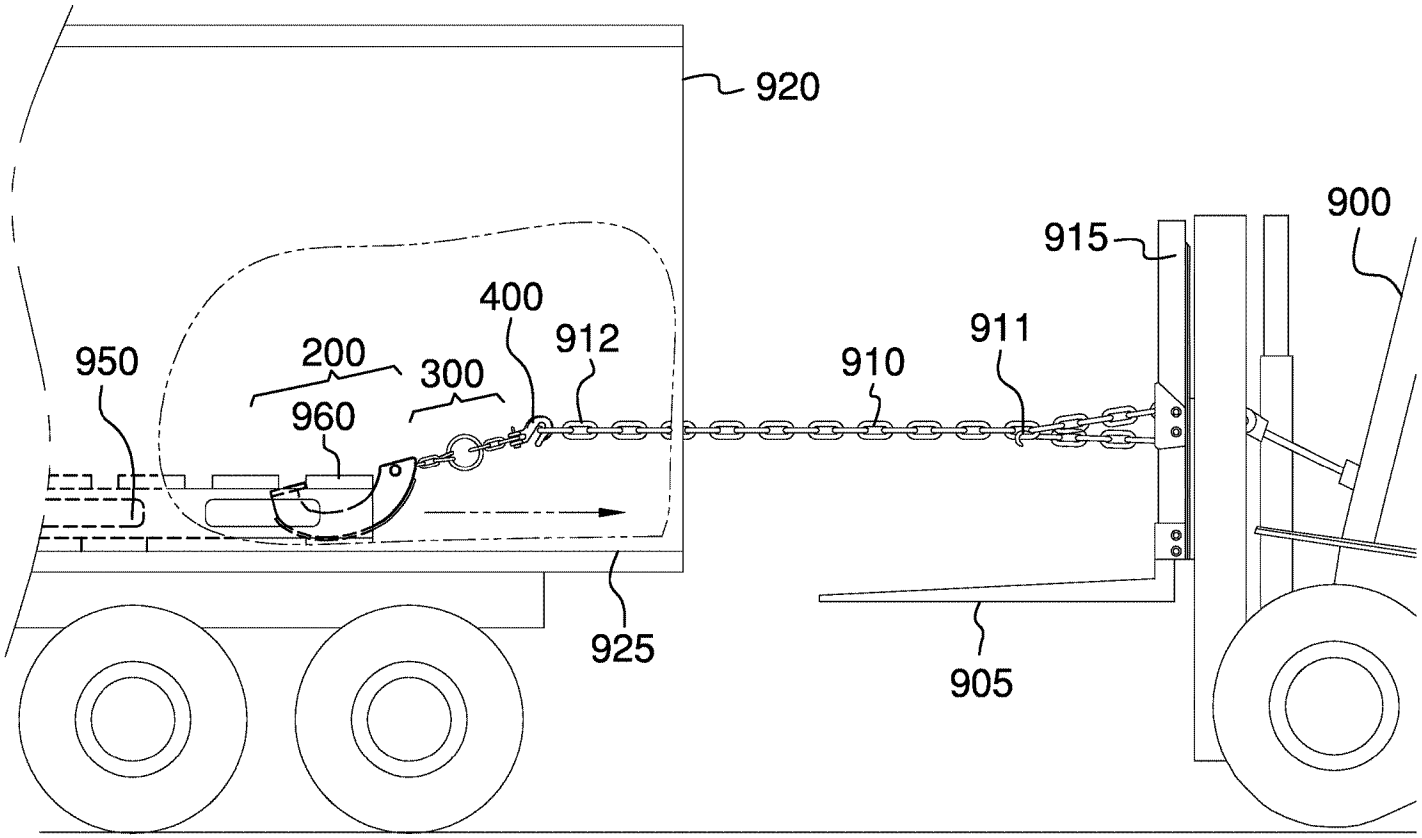
FIG. 5 is an in-use view of an embodiment of the disclosure showing attachment to a pallet deep without a semi-trailer.

Detailed reference will now be made to a first potential embodiment of the disclosure, which is illustrated in FIGS. 1 through 5.

The pallet-pulling device 100 (hereinafter invention) comprises a skid puller 200, a bridle chain 300, and a clevis grab hook 400. The invention 100 may be used to pull a pallet 950 bearing cargo out of a semi-trailer or other elevated shipping container 920.

The skid puller 200 comprises a plurality of ribs, a backing plate 230, a pull plate 240, a bolt 250, and a nut 255. The skid puller 200 is coupled to the pallet 950 by hooking a leading edge 245 of the pull plate 240 behind an upper board 960 on the pallet 950. The skid puller 200 is decoupled from the pallet 950 by lifting the bridle chain 300 and allowing the pull plate 240 to drop from behind the upper board 960.

The plurality of ribs comprises a first rib 211, a second rib 212, a third rib 213, and a fourth rib 214. The plurality of ribs may be vertically oriented and parallel to each other.

The first rib 211 may be a metal plate in the shape of half of an annulus with the ends of the annulus pointing up. The first rib 211 is defined with a first end of the first rib 221 and a second end of the first rib 222. The first end of the first rib 221 and the second end of the first rib 222 may be flattened and oriented to be coincident with a horizontal plane. The first rib 211 may comprise a first rib bolt hole (not illustrated in the figures) below the first end of the first rib 221 through which the bolt 250 may be passed.

The second rib 212 may be a metal plate in the shape of half of an annulus with the ends of the annulus pointing up. The second rib 212 is defined by a first end of the second rib 223 and a second end of the second rib 224. The first end of the second rib 223 and the second end of the second rib 224 may be flattened and oriented to be coincident with a horizontal plane. The second rib 212 may comprise a second rib bolt hole (not illustrated in the figures) below the first end of the second rib 223 through which the bolt 250 may be passed.

The third rib 213 may be a metal plate in the shape of half of an annulus with the ends of the annulus pointing up. The third rib 213 is defined by a first end of the third rib 225 and a second end of the third rib 226. The first end of the third rib 225 and the second end of the third rib 226 may be flattened and oriented to be coincident with a horizontal plane. The third rib 213 may comprise a third rib bolt hole (not illustrated in the figures) below the first end of the third rib 225 through which the bolt 250 may be passed.

The fourth rib 214 may be a metal plate in the shape of half of an annulus with the ends of the annulus pointing up. The fourth rib 214 is defined by a first end of the fourth rib 227 and a second end of the fourth rib 228. The first end of the fourth rib 227 and the second end of the fourth rib 228 may be flattened and oriented to be coincident with a horizontal plane. The fourth rib 214 may comprise a fourth rib bolt hole (not illustrated in the figures) below the first end of the fourth rib 227 through which the bolt 250 may be passed.

The backing plate 230 may be a metal plate curved to match the contour of the bottom of the first rib 211, the second rib 212, the third rib 213, and the fourth rib 214 when the plurality of ribs are aligned parallel to each other. The backing plate 230 intentionally does not extend forward all the way to the first end of the first rib 221, the first end of the second rib 223, the first end of the third rib 225, and the first end of the fourth rib 227 so that a first chain 311 and a second chain 312 may reach the bolt 250. The first rib 211, the second rib 212, the third rib 213, and the fourth rib 214 may couple to the backing plate 230 with equidistant spacing. Specifically, the bottom of the first rib 211, the bottom of the second rib 212, the bottom of the third rib 213, and the bottom of the fourth rib 214 may be coupled to an inside radius 235 of the backing plate 230.

The pull plate 240 may be a flat, metal plate that is coupled to the second end of the first rib 222, the second end of the second rib 224, the second end of the third rib 226, and the second end of the fourth rib 228. The leading edge 245 of the pull plate 240 extends forward of the second end of the first rib 222, the second end of the second rib 224, the second end of the third rib 226, and the second end of the fourth rib 228 to serve as a hook that captures the upper board 960 of the pallet 950 when the invention 100 is in use.

The bolt 250 may serve as a point of attachment point between the skid puller 200 and the first chain 311 and between the skid puller 200 and the second chain 312. The bolt 250 may be retained in place by the nut 255. The bolt 250 may pass through the first rib bolt hole, the second rib bolt hole, the third rib bolt hole, and the fourth rib bolt hole. A head of the bolt 260 and the nut 255 retain the bolt 250 in position. The nut 255 may be a locking acorn nut.

The bridle chain 300 comprises the first chain 311, the second chain 312, a third chain 313, and a central link 330. The bridle chain 300 may couple the skid puller 200 to the clevis grab hook 400.

The first chain 311 may be a section of cargo chain. The first chain 311 is defined with a first end of the first chain 319 and a second end of the first chain 320. The first end of the first chain 319 may couple to the central link 330. The second end of the first chain 320 may couple to the skid puller 200 using the bolt 250 and the nut 255. The point of attachment of the first chain 311 to the skid puller 200 may be between the first rib 211 and the second rib 212.

The second chain 312 may be a section of cargo chain. The second chain 312 is defined with a first end of the second chain 321 and a second end of the second chain 322. The first end of the second chain 321 may couple to the central link 330. The second end of the second chain 322 may couple to the skid puller 200 using the bolt 250 and the nut 255. The point of attachment to the skid puller 200 may be between the third rib 213 and the fourth rib 214.

The third chain 313 may be a section of cargo chain. The third chain 313 is defined with a first end of the third chain 323 and a second end of the third chain 324. The first end of the third chain 323 may couple to the central link 330. The second end of the third chain 324 may couple to the clevis grab hook 400 using a clevis pin 410 and a cotter pin 415.

The central link 330 may be a link that couples the first chain 311, the second chain 312, and the third chain 313 together. In some embodiments, the central link 330 may be a circular split ring.

The clevis grab hook 400 may be a hook with a narrow throat that securely fits over the side of a link in a forklift chain 910 and will not slide past the adjacent links. The clevis grab hook 400 may be used to couple the invention 100 to the forklift chain 910. The forklift chain 910 may be a cargo chain that is secured to a backrest 915 of a forklift 900. The forklift chain 910 may be long enough to reach from the forklift 900 which is outside of the elevated shipping container 920 to the rear of the elevated shipping container 920.

The clevis grab hook 400 may couple to the second end of the third chain 324 using the clevis pin 410 and the cotter pin 415. Specifically, the clevis pin 410 may slide through a first clevis pin hole 401 on one side of the clevis grab hook 400, through the second end of the third chain 324, and through a second clevis pin hole 402 on the other side of the clevis grab hook 400. The clevis pin 410 may be retained in place by a clevis pin head 420 on one end of the clevis pin 410 and by the cotter pin 415 on the other end of the clevis pin 410. The cotter pin 415 may be a hairpin cotter keypin. The cotter pin 415 may be retained in a pinhole (not illustrated in the figures) by spreading the ends of the cotter pin 415 after it has passed through the pinhole.

The bridle chain 300 may equalize the pulling force on the pallet 950. If the side of the skid puller 200 where the second end of the first chain 320 is attached is farther away from the clevis grab hook 400, then the first chain 311 will be stretched while the second chain 312 will have slack. As the clevis grab hook 400 is pulled away from the pallet 950 the side of the skid puller 200 where the second end of the first chain 320 is attached will move forward first. When the first chain 311 and the second chain 312 are stretched equally, then the pallet 950 will move straight forward towards the forklift 900. Likewise, if the side of the skid puller 200 where the second end of the second chain 322 is attached is farther away from the clevis grab hook 400, then that side will move first until the first chain 311 and the second chain 312 are stretched equally, at which time the pallet 950 will move straight forward.

In some embodiments, the skid puller 200 may be fabricated from welded aluminum.

In use, the skid puller 200 is placed into the pallet 950 and tilted to hook the leading edge 245 of the pull plate 240 onto the upper board 960 at the front of the forklift 900. The front of the skid puller 200 is then lowered so that the backing plate 230 supports the weight of the skid puller 200. The clevis grab hook 400 is pulled forward to extend the bridle chain 300. The forklift 900 is positioned in front of the open door of the elevated shipping container 920 far enough away so that the forks 905 on the forklift 900 are not at risk of hitting the elevated shipping container 920 as the forks 905 are raised or lowered. The forks 905 are raised or lowered to place the backrest 915 of the forklift 900 at the height of the floor 925 of the elevated shipping container 920. A first end of the forklift chain 911 is coupled to the backrest 915 and a second end of the forklift chain 912 is pulled into the elevated shipping container 920 towards the pallet 950. The clevis grab hook 400 is attached to the second end of the forklift chain 912. The forklift 900 is backed away from the elevated shipping container 920 until the pallet 950 is at the door of the elevated shipping container 920. The forklift chain 910 may be disconnected from the clevis grab hook 400 and the backrest 915. The forklift 900 may then be driven to insert the forks 905 into the pallet 950, lift the pallet 950, and remove the pallet 950 from the elevated shipping container 920. If there are additional pallets remaining inside of the pallet 950, the process may be repeated.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "annulus" is a two dimensional torus structure.

As used herein, "bridle chain" refers to two or more lengths of chain that are brought together at a central link.

As used in this disclosure, "cargo" refers to one or more objects that are intended to be transported using a vehicle.

As used herein, the words "couple", "couples", "coupled" or "coupling", mean connected, either directly or indirectly and does not necessarily imply a mechanical connection.

As used herein, a "forklift" is a vehicle having a movable fork attached to a mast on the front of the vehicle. The forklift may be positioned to place the fork under a palletized cargo and the fork may be lifted on the mast to raise the cargo off of the ground. While off the ground the cargo may be moved to a different location or may be lifted onto a trailer or shelving. Once the cargo is in place, the forklift operator may lower the fork slightly to place the cargo on a supporting surface and back away to disengage the forklift from the cargo. Forklifts often comprise a counterweight on the back of the vehicle to prevent tipping while moving a cargo. In some cases forklifts comprise a tilt mechanism that can change the angle of the fork to reduce the likelihood of the cargo slipping off.

As used herein, "front" means the side of an object that is closest to a forward direction of travel under normal use of the object or the side or part of an object that normally presents itself to view or that is normally used first. "Rear" or "back' refers to the side that is opposite the front.

As used herein, a "grab hook" or "clevis grab hook" is hook commonly used at the end of a transport chain. It attaches to the end of the chain using a pin or bolt. The grab hook has a narrow throat that securely fits over the side of a link in the chain and will not slide past the adjacent links, which is oriented perpendicularly to the link that the grab hook is grasping. Its intended use is for securing the end of the chain to a cargo or post by wrapping the chain around the item and hooking the end of the chain onto itself using the grab hook.

As used in this disclosure, "horizontal" is a directional term that refers to a direction that is perpendicular to the local force of gravity. Unless specifically noted in this disclosure, the horizontal direction is always perpendicular to the vertical direction.

As used herein, a "pallet" is a shipping platform to which a cargo is fastened. The pallet makes it easier for a forklift to move the cargo by providing a space for the forks to slide under the cargo. Pallets are generally made of wood or plastic. A typical pallet has three or four evenly spaced stringer boards oriented in a vertical direction with five to ten deck planks attached across the top of all three stringers and a smaller number of planks attached across the bottom of the three stringers. A common size for a pallet in the U.S. is 40 inches wide by 48 inches long an approximately 5 inches high however other sizes are used. A "skid" is similar to a pallet except that a skid does not have the planks on the underside of the vertical boards.

As used in this disclosure, a "plate" is a smooth, flat and rigid object having at least one dimension that is of uniform thickness and appears thinner than the other dimensions of the object. Plates often have a rectangular or disk like appearance. Plates may be made of any material, but are commonly made of metal.

As used herein, a "semi-trailer" is a trailer having wheels at the back but lacking a front axle. A semi-trailer is supported at the front by a towing vehicle. A semi-trailer is the trailer portion of a tractor-trailer or 18-wheeler.

As used herein, a "tow chain", "transport chain", or "cargo chain" is a high quality, high strength steel chain intended for use in pulling or securing heavy loads. Clevis grab hooks are generally provided on each end of the tow chain.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A pallet-pulling device comprising:

a skid puller, a bridle chain, and a clevis grab hook;

wherein the pallet-pulling device is used to pull a pallet out of an elevated shipping container;

wherein the skid puller comprises a plurality of ribs, a backing plate, a pull plate, a bolt, and a nut;

wherein the skid puller is coupled to the pallet by hooking a leading edge of the pull plate behind an upper board on the pallet;

wherein the skid puller is decoupled from the pallet by lifting the bridle chain and allowing the pull plate to drop from behind the upper board.

2. The pallet-pulling device according to claim 1 wherein the plurality of ribs comprises a first rib, a second rib, a third rib, and a fourth rib;

wherein the plurality of ribs are vertically oriented and parallel to each other.

3. The pallet-pulling device according to claim 2 wherein the first rib is a metal plate in the shape of half of an annulus with the ends of the annulus pointing up;

wherein the first rib is defined by a first end of the first rib and a second end of the first rib;

wherein the first end of the first rib and the second end of the first rib are flattened and oriented to be coincident with a horizontal plane;

wherein the first rib comprises a first rib bolt hole below the first end of the first rib through which the bolt is passed.

4. The pallet-pulling device according to claim 3 wherein the second rib is a metal plate in the shape of half of an annulus with the ends of the annulus pointing up;

wherein the second rib is defined by a first end of the second rib and a second end of the second rib;

wherein the first end of the second rib and the second end of the second rib are flattened and oriented to be coincident with the horizontal plane;

wherein the second rib comprises a second rib bolt hole below the first end of the second rib through which the bolt is passed.

5. The pallet-pulling device according to claim 4 wherein the third rib is a metal plate in the shape of half of an annulus with the ends of the annulus pointing up;

wherein the third rib is defined by a first end of the third rib and a second end of the third rib;

wherein the first end of the third rib and the second end of the third rib are flattened and oriented to be coincident with the horizontal plane;

wherein the third rib comprises a third rib bolt hole below the first end of the third rib through which the bolt is passed.

6. The pallet-pulling device according to claim 5 wherein the fourth rib is a metal plate in the shape of half of an annulus with the ends of the annulus pointing up;

wherein the fourth rib is defined by a first end of the fourth rib and a second end of the fourth rib;

wherein the first end of the fourth rib and the second end of the fourth rib are flattened and oriented to be coincident with the horizontal plane;

wherein the fourth rib comprises a fourth rib bolt hole below the first end of the fourth rib through which the bolt is passed.

7. The pallet-pulling device according to claim 6 wherein the backing plate is a metal plate curved to match the contour of the bottom of the first rib, the second rib, the third rib, and the fourth rib when the plurality of ribs are aligned parallel to each other;

wherein the backing plate intentionally does not extend forward all the way to the first end of the first rib, the first end of the second rib, the first end of the third rib, and the first end of the fourth rib so that a first chain and a second chain reach the bolt;

wherein the first rib, the second rib, the third rib, and the fourth rib couple to the backing plate with equidistant spacing;

wherein the bottom of the first rib, the bottom of the second rib, the bottom of the third rib, and the bottom of the fourth rib are coupled to an inside radius of the backing plate.

8. The pallet-pulling device according to claim 7 wherein the pull plate is a flat, metal plate that is coupled to the second end of the first rib, the second end of the second rib, the second end of the third rib, and the second end of the fourth rib;

wherein the leading edge of the pull plate extends forward of the second end of the first rib, the second end of the second rib, the second end of the third rib, and the second end of the fourth rib to serve as a hook that captures the upper board of the pallet when the pallet-pulling device is in use.

9. The pallet-pulling device according to claim 8 wherein the bolt serves as a point of attachment point between the skid puller and the first chain and between the skid puller and the second chain;

wherein the bolt passes through the first rib bolt hole, the second rib bolt hole, the third rib bolt hole, and the fourth rib bolt hole;

wherein a head of the bolt and the nut retain the bolt in position.

10. The pallet-pulling device according to claim 9 wherein the nut is a locking acorn nut.

11. The pallet-pulling device according to claim 9 wherein the bridle chain comprises the first chain, the second chain, a third chain, and a central link;

wherein the bridle chain couples the skid puller to the clevis grab hook.

12. The pallet-pulling device according to claim 11 wherein the first chain is a section of cargo chain;

wherein the first chain is defined by a first end of the first chain and a second end of the first chain;

wherein the first end of the first chain couples to the central link;

wherein the second end of the first chain couples to the skid puller using the bolt and the nut;

wherein the point of attachment of the first chain to the skid puller is between the first rib and the second rib;

wherein the second chain is a section of cargo chain;

wherein the second chain is defined by a first end of the second chain and a second end of the second chain;

wherein the first end of the second chain couples to the central link;

wherein the second end of the second chain couples to the skid puller using the bolt and the nut;

wherein the point of attachment to the skid puller is between the third rib and the fourth rib.

13. The pallet-pulling device according to claim 12 wherein the third chain is a section of cargo chain;

wherein the third chain is defined by a first end of the third chain and a second end of the third chain;

wherein the first end of the third chain couples to the central link;

wherein the second end of the third chain couples to the clevis grab hook using a clevis pin and a cotter pin.

14. The pallet-pulling device according to claim 13 wherein the central link is a link that couples the first chain, the second chain, and the third chain together.

15. The pallet-pulling device according to claim 14 wherein the central link is a circular split ring.

16. The pallet-pulling device according to claim 14 wherein the clevis grab hook is a hook with a narrow throat that securely fits over the side of a link in a forklift chain and will not slide past the adjacent links;

wherein the clevis grab hook is used to couple the pallet-pulling device to the forklift chain;

wherein the forklift chain is a cargo chain that is secured to a backrest of a forklift.

17. The pallet-pulling device according to claim 16 wherein the clevis grab hook couples to the second end of the third chain using the clevis pin and the cotter pin;

wherein the clevis pin slides through a first clevis pin hole on one side of the clevis grab hook, through the second end of the third chain, and through a second clevis pin hole on the other side of the clevis grab hook;

wherein the clevis pin is retained in place by a clevis pin head on one end of the clevis pin and by the cotter pin on the other end of the clevis pin.

18. The pallet-pulling device according to claim 17 wherein the bridle chain equalizes the pulling force on the pallet.

19. The pallet-pulling device according to claim 18 wherein the skid puller is fabricated from welded aluminum.

* * * * *